US011808087B2

(12) United States Patent
Dourfaye et al.

(10) Patent No.: US 11,808,087 B2
(45) Date of Patent: Nov. 7, 2023

(54) DRILL BIT WITH MULTIPLE CUTTING STRUCTURES

(71) Applicant: Varel Europe S.A.S., Pau (FR)

(72) Inventors: Alfazazi Dourfaye, Paris (FR); Gilles Gallego, Ibos (FR); Bruno Cuillier de Maindreville, Pau (FR)

(73) Assignee: Varel Europe S.A.S., Nousty (FR)

( * ) Notice: Subject to any disclaimer, the term of this patent is extended or adjusted under 35 U.S.C. 154(b) by 127 days.

(21) Appl. No.: 17/630,724

(22) PCT Filed: Jul. 22, 2020

(86) PCT No.: PCT/IB2020/056922
§ 371 (c)(1),
(2) Date: Jan. 27, 2022

(87) PCT Pub. No.: WO2021/048648
PCT Pub. Date: Mar. 18, 2021

(65) Prior Publication Data

US 2022/0259926 A1 Aug. 18, 2022

(30) Foreign Application Priority Data

Sep. 11, 2019 (EP) ..... 19315111

(51) Int. Cl.
*E21B 10/42* (2006.01)
*E21B 10/62* (2006.01)
*E21B 10/32* (2006.01)

(52) U.S. Cl.
CPC ..... *E21B 10/325* (2013.01); *E21B 10/42* (2013.01); *E21B 10/62* (2013.01)

(58) Field of Classification Search
CPC ..... E21B 10/42; E21B 10/62; E21B 10/325
See application file for complete search history.

(56) References Cited

U.S. PATENT DOCUMENTS 1,156,147 A * 10/1915 Karns ..... E21B 10/32 175/291
5,361,859 A * 11/1994 Tibbitts ..... E21B 10/66 175/286
5,560,440 A 10/1996 Tibbits
6,142,250 A 11/2000 Griffin
(Continued)

FOREIGN PATENT DOCUMENTS

CN 207406277 U * 5/2018

OTHER PUBLICATIONS

EPO Search Report and Opinion for Application No. 19 31 5111 dated Feb. 17, 2020.

*Primary Examiner* — Theodore N Yao

(57) ABSTRACT

A bit for drilling a wellbore includes: a shank having a coupling formed at an upper end thereof; a body removably attached to a lower end of the shank and having a blade receptacle formed therethrough; a blade fixed to the body; a plurality of superhard cutters mounted along a leading edge of the fixed blade; a blade disposed in the blade receptacle and longitudinally movable relative to the body between an extended position and a retracted position; a plurality of superhard cutters mounted along a leading edge of the movable blade; and a spring disposed between the shank and the movable blade and biasing the movable blade toward the extended position.

15 Claims, 4 Drawing Sheets

(56) References Cited

U.S. PATENT DOCUMENTS

| | | | | |
|---|---|---|---|---|
| 7,681,667 | B2 * | 3/2010 | Pia | E21B 10/322 175/286 |
| 8,011,457 | B2 * | 9/2011 | Hall | E21B 4/14 175/317 |
| 8,061,455 | B2 | 11/2011 | Beuershausen | |
| 2017/0130533 | A1 | 5/2017 | Ling | |
| 2018/0363381 | A1 * | 12/2018 | Guan | E21B 4/06 |
| 2021/0087888 | A1 | 3/2021 | Macfarlane | |

* cited by examiner

DRILL BIT WITH MULTIPLE CUTTING STRUCTURES

BACKGROUND OF THE DISCLOSURE

Field of the Disclosure

The present disclosure generally relates to a drill bit with multiple cutting structures.

Description of the Related Art

U.S. Pat. No. 5,560,440 discloses a rotary bit for drilling subterranean formations. The bit includes a separately-fabricated bit body and cutter support structures, the latter of which may be designed as blades, ribs, pads or otherwise, depending upon the bit style. The body and one or more cutter support structures are assembled and secured together after fabrication. Separate fabrication of the cutter support structures permits more precise cutter positioning, as well as orientation, and promotes the use of stronger and more diverse cutter affixation means. The cutter support structures may be adjustably radially movable with respect to the bit body, so as to provide the ability to fabricate bits of various gage sizes within a range using a single bit body and single size of cutter support structure.

U.S. Pat. No. 6,142,250 discloses formation engaging elements moveably mounted onto a drill bit. Such elements may be used to protect other rigidly mounted formation engaging elements from impacts that occur during use of the drill bit, or they may be used to alter the aggressiveness of the drill bit when used in directional drilling operations.

U.S. Pat. No. 8,061,455 discloses a drill bit including a blade profile having a cone section and one or more cutters on the cone section configured to retract from an extended position when an applied load on the drill bit reaches or exceeds a selected threshold. The drill bit is less aggressive when the cutters are in the retracted position compared to when the cutters are in the extended position.

US 2017/0130533 discloses an Earth drill bit including a bit body assembly and a plurality of separately movable cutting elements carried by the bit body assembly. The bit body assembly is arranged around a central bit body axis and includes a hydraulic circuit. The plurality of separately movable cutting elements is movable in a direction parallel to the central bit body axis and supported by fluid in the hydraulic circuit.

SUMMARY OF THE DISCLOSURE

The present disclosure generally relates to a drill bit with multiple cutting structures. In one embodiment, a bit for drilling a wellbore includes: a shank having a coupling formed at an upper end thereof; a body removably attached to a lower end of the shank and having a blade receptacle formed therethrough; a blade fixed to the body; a plurality of superhard cutters mounted along a leading edge of the fixed blade; a blade disposed in the blade receptacle and longitudinally movable relative to the body between an extended position and a retracted position; a plurality of superhard cutters mounted along a leading edge of the movable blade; and a spring disposed between the shank and the movable blade and biasing the movable blade toward the extended position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
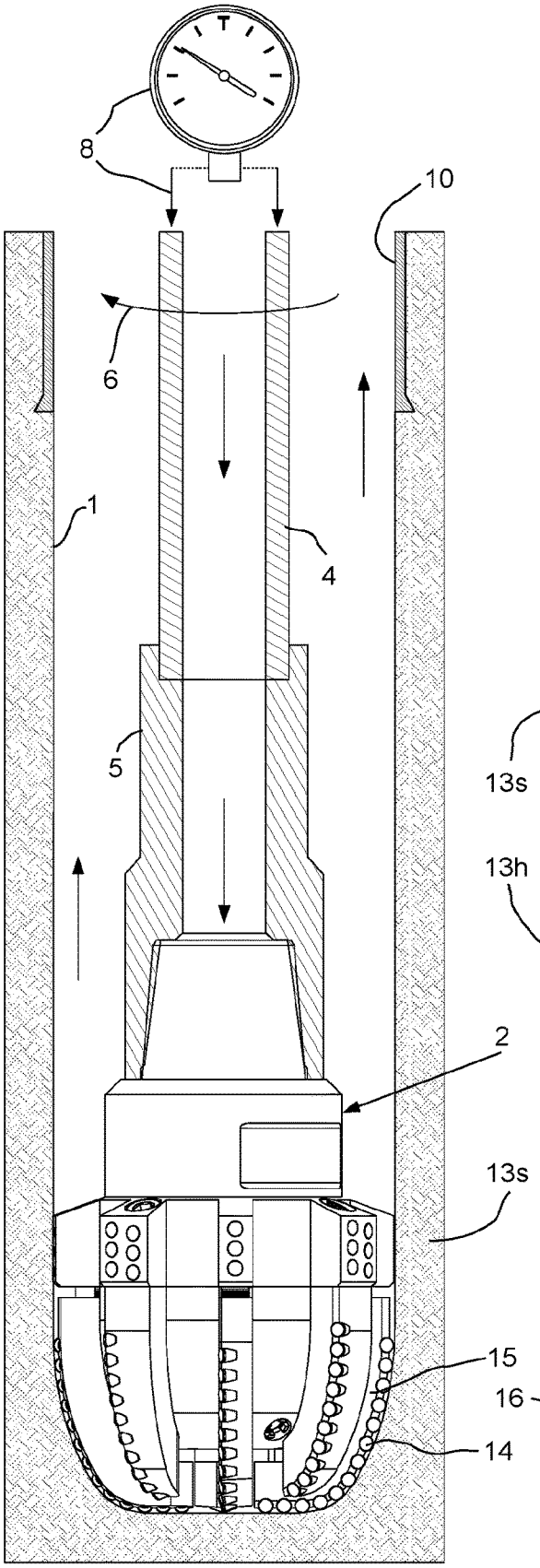
FIG. 1A illustrates drilling of a wellbore with a drill bit having multiple cutting structures in an extended position, according to one embodiment of the present disclosure.
Figure 1B:
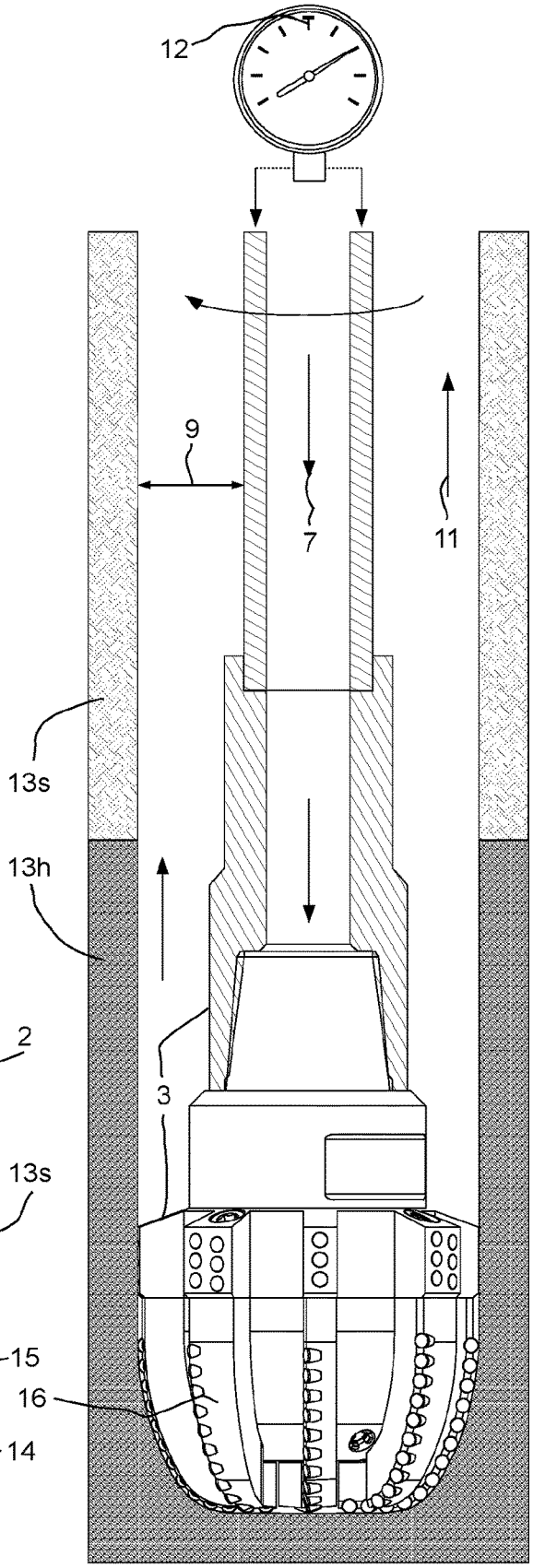
FIG. 1B illustrates drilling of the wellbore with the drill bit in a retracted position.

FIG. 1A illustrates drilling of a wellbore 1 with a drill bit 2 having multiple cutting structures in an extended position, according to one embodiment of the present disclosure. FIG. 1B illustrates drilling of the wellbore 1 with the drill bit 2 in a retracted position. A BHA 3 may be connected to a bottom of a pipe string 4, such as drill pipe or coiled tubing, thereby forming a drill string, and deployed into the wellbore 1. The BHA 3 may include one or more drill collars 5, and the drill bit 2. The drill bit 2 may be rotated at an angular velocity 6, such as by rotation of the drill string from a rig (not shown) and/or by a drilling motor (not shown) of the BHA 3, while drilling fluid 7, such as mud, may be pumped down the drill string. Some of the weight 8 of the drill string (aka weight on bit (WOB)) may be set on the drill bit 2. The drilling fluid 7 may be discharged by the drill bit 2 and carry cuttings up an annulus 9 formed between the drill string and the wellbore 1 and/or between the drill string and a casing string and/or liner string 10. The drilling fluid and cuttings are collectively referred to as returns 11.

The drill bit 2 may be in the extended position due to the WOB 8 being less than a shifting WOB 12. The extended position may be selected when the wellbore 1 is being drilled through a soft formation 13*s*. In the extended position, cutters 14 of only one or more, such as four, movable blades 15 may be in engagement with the soft formation 13*s* while the cutters 14 of one or more, such as four, fixed blades 16 may be disengaged from the soft formation 13*s*. This retracted position allows the drill bit 2 to operate in an efficient manner of cutting the soft formation 13*s*.

However, once a hard rock formation 13*h* is encountered, use of only the movable blades 15 becomes inefficient. Once the hard rock formation 13*h* is encountered, the WOB 8 may be increased to value greater than the shifting WOB 12, thereby retracting the movable blades 15. In the retracted position, cutters 14 of both the movable blades 15 and the fixed blades 16 may be in engagement with the hard formation 13*h*. This retracted position allows the drill bit 2 to operate in an efficient manner of cutting the hard formation 13*h*. The drill bit 2 may be shifted between the positions without tripping the drill string from the wellbore 1. Once the hard formation 13*h* has been drilled through, the drill bit 2 may be shifted back to the extended position by reducing the WOB 8 to a value less than the shifting WOB 12. The drill bit 2 may be repeatedly shifted between the positions as many times as required to drill the wellbore 1 to total depth or to finish drilling an interval thereof.

Alternatively, the drill bit 2 may be shifted from the extended position to the retracted position in response to dulling of the cutters 14 of the movable blades 15.

Figure 2A:
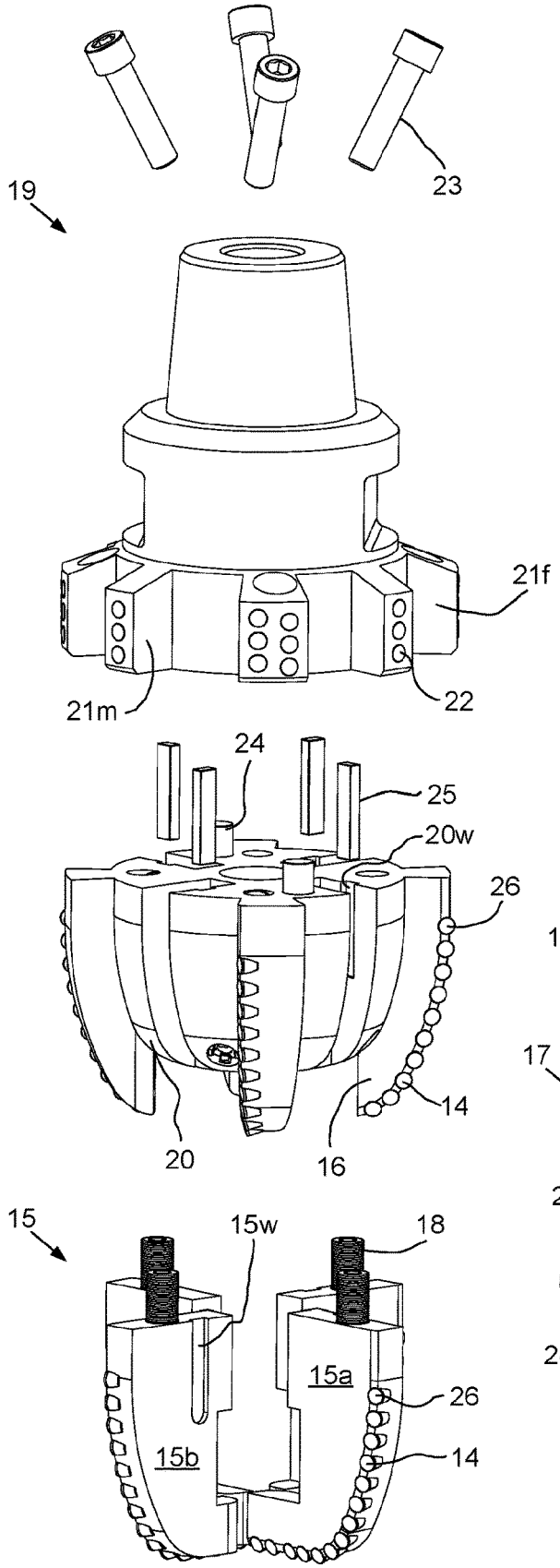
FIG. 2A illustrates assembly of the drill bit.
Figure 2B:
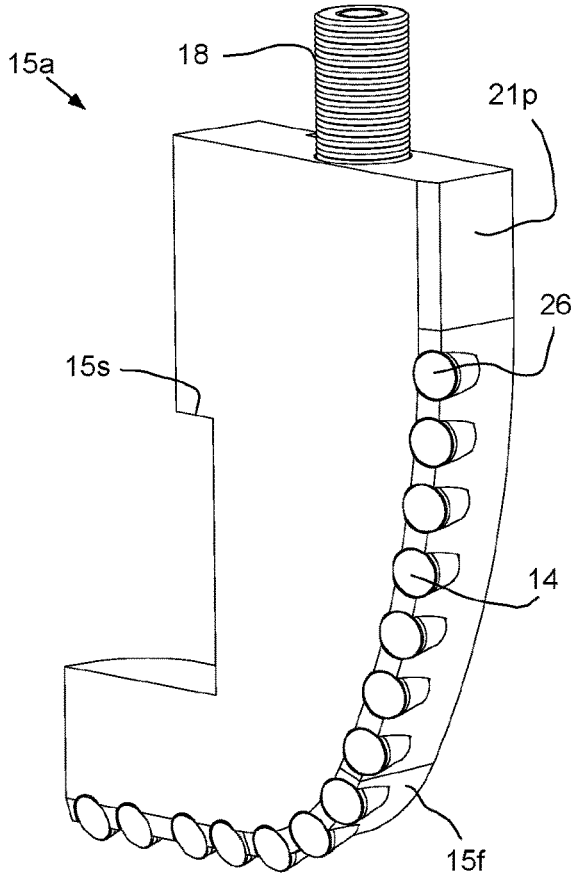
FIG. 2B illustrates a movable blade of the drill bit.
Figure 2C:
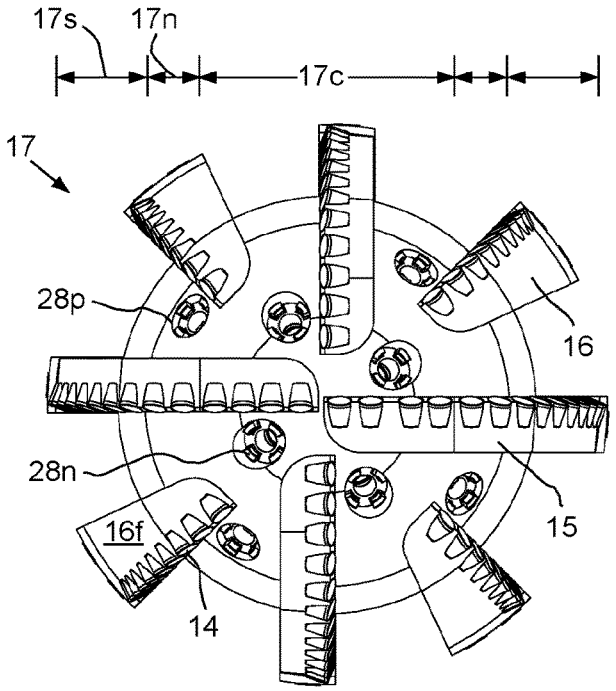
FIG. 2C illustrates a cutting face of the drill bit.
Figure 3A:
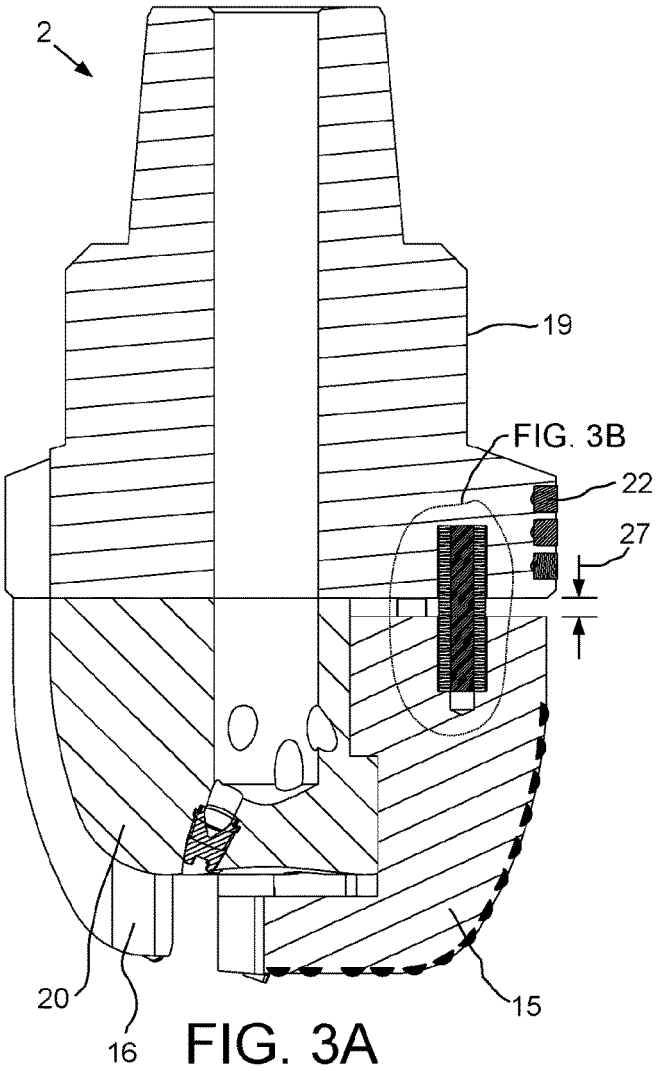
FIGS. 3A and 4A illustrate the drill bit in the extended position.
Figure 3C:
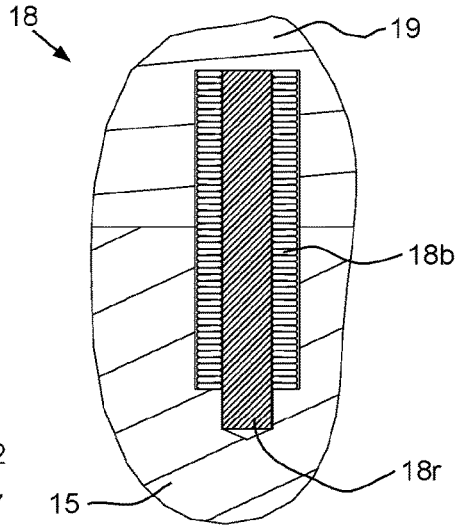
FIG. 3C illustrates the spring stack in the retracted position.
Figure 3B:
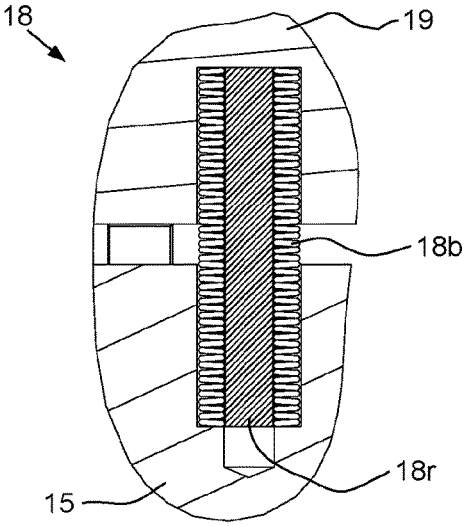
FIG. 3B illustrates a spring stack of the drill bit in the extended position.
Figure 3D:
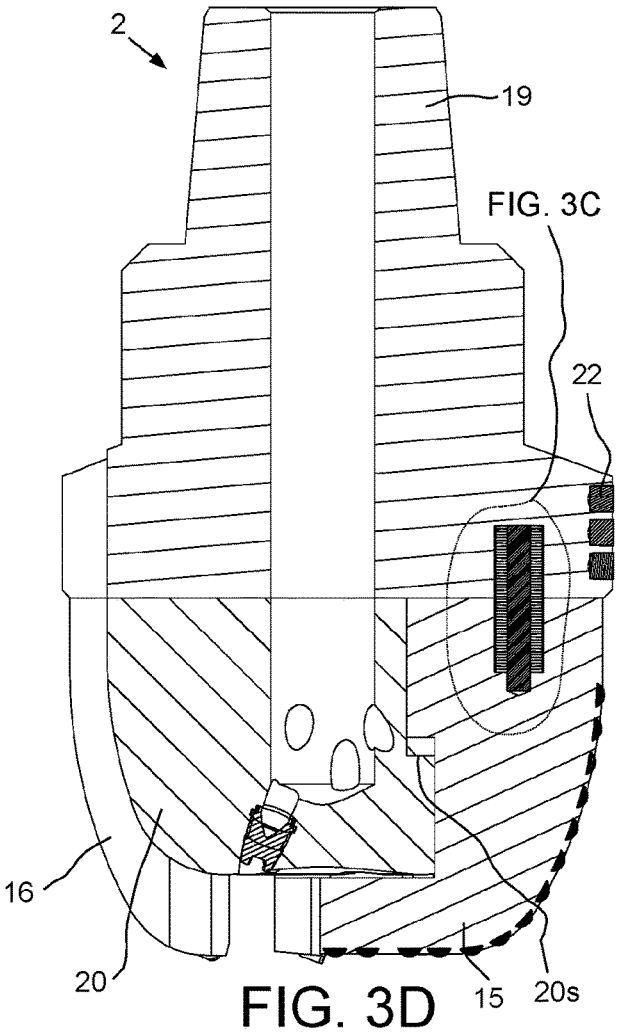
FIGS. 3D and 4B illustrate the drill bit in the retracted position
Figure 4A:
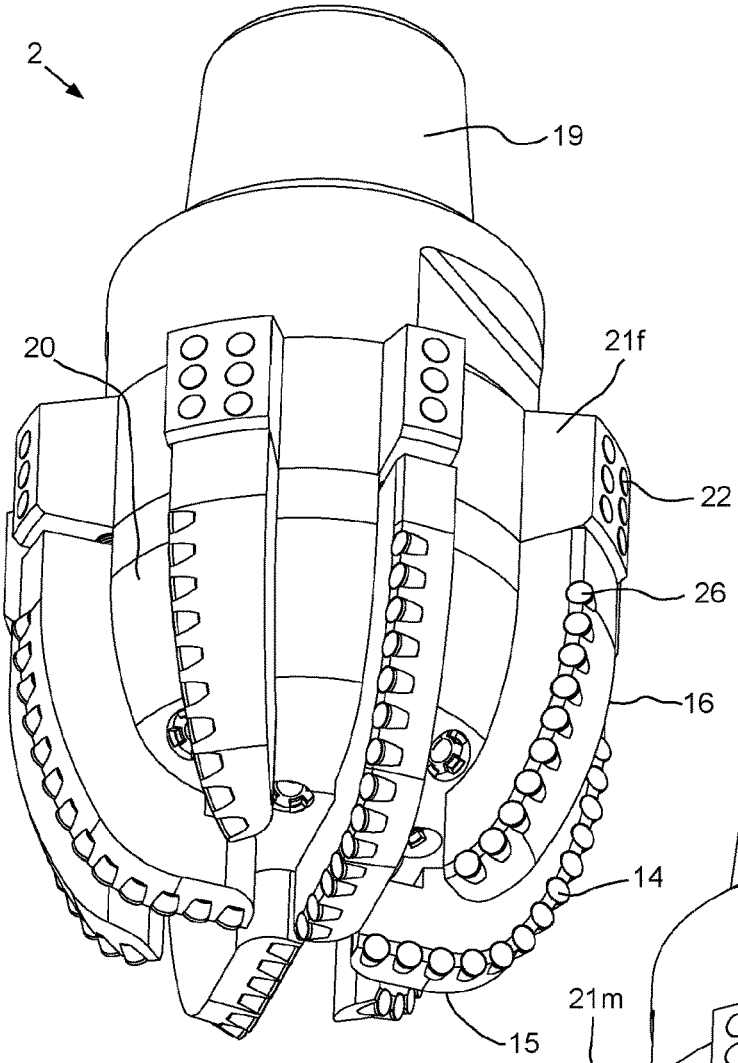
Figure 4B:
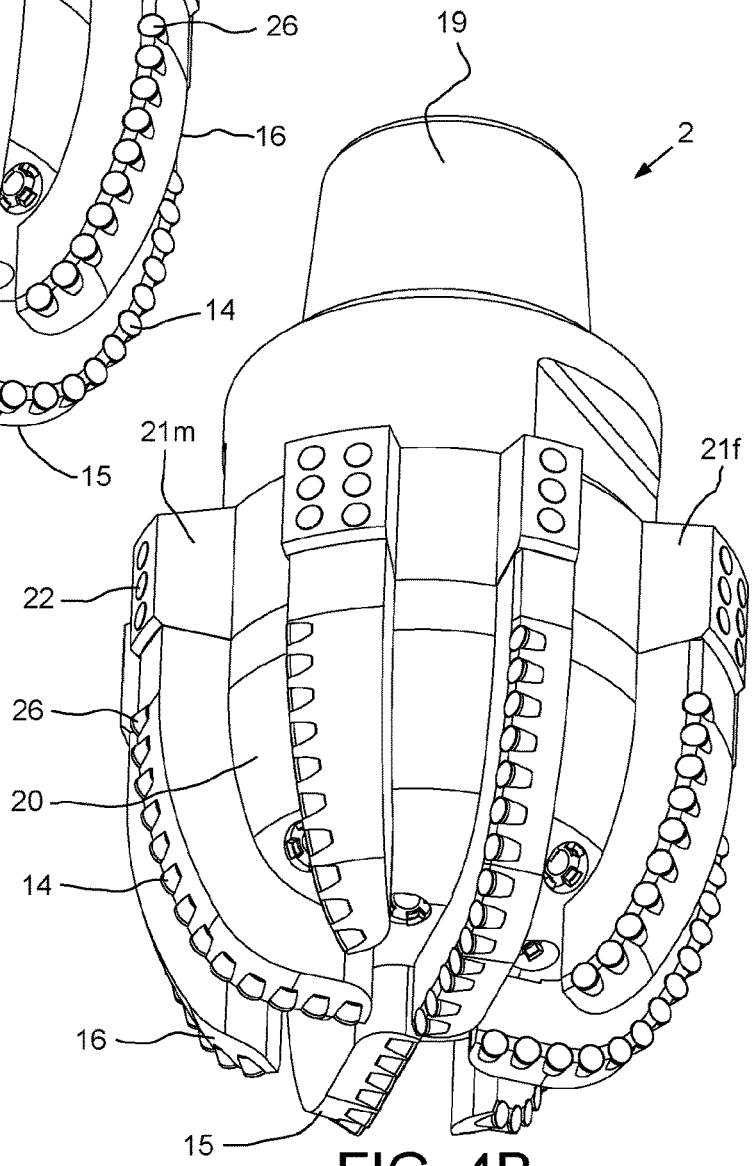

FIG. 2A illustrates assembly of the drill bit 2. FIG. 2B illustrates a movable blade 15*a* of the drill bit 2. FIG. 2C illustrates a cutting face 17 of the drill bit 2. FIGS. 3A and 4A illustrate the drill bit 2 in the extended position. FIG. 3B illustrates a spring stack 18 of the drill bit 2 in the extended position. FIG. 3C illustrates the spring stack 18 in the retracted position. FIGS. 3D and 4B illustrate the drill bit 2 in the retracted position.

The drill bit 2 may include a plurality of the movable blades 15, a plurality of the fixed blades 16, a shank 19, and a body 20. The shank 19 may be tubular and made from a metal or alloy, such as steel, and have a coupling, such as a threaded pin, formed at an upper end thereof for connection of the drill bit 2 to the drill collar 5 or other member of the BHA 3. The shank 19 may have a flow bore formed therethrough and the flow bore may be in fluid communication with a plenum of the body 20. The shank 19 may have a mid section with an enlarged outer diameter relative to the coupling and a pair of wrench flats formed in an outer surface thereof. The shank 19 may also have a lower gage (aka gauge) section with an enlarged base diameter relative to the mid section and having a plurality of protruding gage pads 21*f,m* formed around the gage section and junk slots formed between the gage pads. The gage section may include a gage pad 21*f* for each fixed blade 16 and a gage pad 21*m* for each movable blade 15. Each gage pad 21*f,m* may be aligned with the respective blade 15, 16 and have a circumferential width corresponding to that of the respective blade. Each gage pad 21*f,m* may be formed with the shank 19 and may protrude therefrom such that the gage pads are a unitary one-piece structure with the shank.

Each gage pad 21*f,m* may have a rectangular mid portion and a tapered upper and lower portions. The tapered upper portions may transition an outer diameter of the drill bit 2 from the gage diameter to a lesser diameter of the shank 19. The tapered lower portions may transition the outer diameter of the drill bit 2 from the gage diameter to a lesser diameter of a gage section of the blades 15, 16. The rectangular mid portions may have essentially flat outer surfaces with sockets formed therein for receiving gage protectors 22. Each gage pad 21*f,m* may have one or more longitudinal rows of gage protectors 22. Each gage protector 22 may be mounted in the respective socket, such as by interference fit or brazing. An exposed end of each gage protector 22 may protrude slightly past the outer surface of the respective gage pad 21*f,m* to prevent the outer surface thereof from contacting the wall of the wellbore 1.

Alternatively, an outer portion of each gage pad 21*f,m* may be hard faced instead of or in addition to having the gage protectors 22. Alternatively, the gage section of the shank 19 and/or the gage pads 21*f,m* may be made from a composite material, such as a ceramic and/or cermet matrix powder infiltrated by a metallic binder.

A bottom of the shank 19 may mount to a top of the body 20. Each gage pad 21*f* may have an inclined hole extending form the upper portion thereof and to a bottom of the gage section of the shank 19. The body 20 may have corresponding inclined threaded sockets formed therein and extending from the top thereof. Each hole and the respective threaded socket may receive a respective threaded fastener 23, thereby removably attaching the shank 19 and the body 20. Each hole may be counterbored so that a head of the respective threaded fastener 23 is flush or sub-flush with the upper portion of the respective gage pad 21*f*. The shank 19 may also have a plurality of longitudinal spring sockets formed therein and extending from the bottom thereof. Each spring socket may be located adjacent to one of the gage pads 21*m* and may receive an upper portion of one of the spring stacks 18. The shank 19 may also have a plurality of longitudinal torque sockets formed therein extending from the bottom thereof. Each torque socket may be located adjacent to one of the junk slots and may receive an upper portion of a respective torque pin 24. A lower portion of each torque pin 24 may be received in a respective longitudinal torque socket formed in the body 20 and extending from the top thereof. The torque pins 24 may transfer torque from the shank 19 to the body 20 so that the threaded fasteners 23 do not have to withstand the torsional loading.

Alternatively, each inclined hole of the respective gage pad 21*f* may extend longitudinally therethrough instead and each inclined threaded socket of the body 20 may be longitudinally straight instead and may extend from the top of a respective fixed blade 16 instead of the body 20.

An interface between the flow bore of the shank 19 and the plenum of the body 20 may be sealed by a face seal (not shown), such as a gasket or polished face (metal to metal); a sleeve (not shown) carrying seals at ends thereof and received in polished bore receptacles (not shown) of each of the shank and the body; or a boss (not shown) formed in one of the shank and the body and carrying a seal and a seal receptacle formed in the other one of the shank and the body for receiving the boss.

The body 20 may have a cylindrical upper portion and a dome shaped lower portion. The fixed blades 16 may be disposed around the body 20 and each fixed blade may be formed with the body and may protrude therefrom such that the fixed blades are a unitary one-piece structure with the body. The body 20 may be formed of a metal or alloy, such as steel. The body 20 may have a longitudinal receptacle for each movable blade 15 formed therethrough, each blade receptacle being formed between a pair of adjacent fixed blades 16. An inner surface of the body 20 adjacent to each blade receptacle may have a reduced diameter portion adjacent to the shank 19, an enlarged diameter portion adjacent to the cutting face 17, and a shoulder 20*s* formed between the portions. The body 20 may also have a longitudinal keyway 20*w*, such as a slot, formed therein adjacent to a trailing end of each blade receptacle and extending from the top of the body. A key 25, such as a rectangular block, may be received in each keyway 20*w* and each key may have a thickness greater than a thickness of the respective keyway such that the key protrudes therefrom.

Each movable blade 15 may also have a longitudinal spring socket formed therein and extending from the top thereof. The spring socket of each movable blade 15 may be aligned with the respective spring socket of the shank 19 and each spring stack may be disposed in a respective pair of aligned spring sockets. Each spring stack 18 may include a guide rod 18*r* and a one or more compression springs, such as a plurality of Belleville washers 18*b*. The Belleville washers 18*b* may be disposed around the guide rod 18*r* and stacked in a series arrangement and/or a parallel arrangement. The spring stacks 18 may longitudinally bias the movable blades 15 toward the extended position. The spring stacks 18 may be in a parallel arrangement. Each spring stack 18 may be identical and the spring stacks 18 configured to have a shifting force equal to the shifting WOB 12 so that when the shifting WOB is applied, the shank 19 and the body 20 move longitudinally downhole relative to the movable blades 15 (which are restrained by the bottom of the wellbore 1) from the extended position to the retracted position. The shifting WOB 12 may range between one third and two thirds of a maximum design WOB of the drill bit 2 or may be greater than or equal to twenty-three hundred kilograms (five thousand pounds), forty-five hundred kilograms (ten thousand pounds), or sixty-eight hundred kilograms (fifteen thousand pounds). In actuality to prevent chattering between the positions, the shifting WOB 12 may be a range including an upper limit and a lower limit which may be plus or minus five, ten, or twenty percent of the nominal shifting WOB (the extended position at WOB less than or equal to the lower limit and the retracted position at WOB greater than or equal to the upper limit).

Each movable blade 15 may have an inner portion for movably coupling to the body 20 and an outer portion for carrying cutters 14 and gage trimmers 26. Each movable blade 15 may be formed of a metal or alloy, such as steel. Each movable blade 15 may be disposed in the respective blade receptacle of the body 20 and longitudinally movable relative to the body and shank 19 between the extended and retracted positions. The inner surface of each movable blade 15 may have an upper protruding portion extending from the top thereof, a lower protruding portion adjacent to a bearing face 15*f* thereof, a mid recessed portion formed between the upper and lower protruding portions, and a shoulder 15*s* formed between the upper protruding portion and the mid recessed portion. Each movable blade 15 may also have a longitudinal keyway 15*w*, such as a slot, formed therein adjacent to a trailing side thereof and extending from the top thereof. The keys 25 may also be received in the keyways 15*w* of the movable blades 15, thereby radially connecting the movable blades 15 to the body 20 while allowing longitudinal movement relative thereto. A thickness of each movable blade 15 may be configured relative to the respective blade receptacle such that a sliding fit is formed between the movable blades 15 and the body 20. Engagement of a trailing side of each movable blade 15 with the trailing side of the respective blade receptacle may transfer torque from the body 20 to the movable blades 15 during drilling of the wellbore 1.

The movable blades 15 may be longitudinally trapped between a bottom of the shank 19 and the shoulders 20*s* of the body. In the extended position, the shoulders 20*s* of the body 20 and the shoulders 15*s* of the movable blades 15 may be engaged and in the retracted position, tops of the movable blades 15 may be engaged with the bottom of the shank 19. A stroke 27 of the drill bit 2 between the extended and retracted positions may range between one-half to one times a diameter of the cutters 14 or may range between four and sixteen millimeters.

Alternatively, the body 20, the fixed blades 16, and/or the movable blades 15 may be made from a composite material, such as a ceramic and/or cermet matrix powder infiltrated by a metallic binder.

The cutting face 17 may be formed by the lower portion of the body 20, the blades 15, 16, the cutters 14, and gage trimmers 26. The movable blades 15 may be primary blades and the fixed blades 16 may be secondary blades. Fluid courses may be formed between the blades 15, 16 and the fluid courses may be in fluid communication with the junk slots of the shank 19. A row of leading cutters 14 may be mounted along each blade 15, 16. The cutting face 17 may have one or more sections, such as an inner cone 17*c*, an outer shoulder 17*s*, and an intermediate nose 17*n* between the cone and the shoulder sections. The blades 15, 16 may be disposed around the cutting face 17. The movable blades 15 and the fixed blades 16 may be arranged about the cutting face 17 in an alternating fashion. One or more (pair shown) 15*a* of the movable blades 15 may each extend from a center of the cutting face, across a portion of the cone section 17*c*, across the nose 17*n* and shoulder 17*s* sections, and either to the gage pads 21*m* (retracted position) or near the gage pads (extended position). One or more (pair shown) 15*b* of the movable blades 15 may each extend from near a center of the cutting face, across a portion of the cone section 17*c*, across the nose 17*n* and shoulder 17*s* sections, and either to the gage pads 21*m* (retracted position) or near the gage pads (extended position). The fixed blades 16 may each extend from a periphery of the cone section 17*c*, across the nose 17*n* and shoulder 17*s* sections, and to the gage pads 21*f*. Each blade 15, 16 may extend radially across the portion of the cone section 17*c* (movable blades 15 only) and nose section 17*n* and across the shoulder section 17*s* radially and longitudinally. The bearing face 15*f* of each movable blade 15 may be essentially flat in the cone section 17*c*.

The leading cutters 14 and gage trimmers 26 may be mounted along leading edges of the blades 15, 16. The leading cutters 14 and gage trimmers 26 may be pre-formed, such as by high pressure and temperature sintering, and mounted, such as by brazing, in respective leading pockets formed in the blades 15, 16 adjacent to the leading edges thereof. Each blade 15, 16 may have a bearing face 15*f*, 16*f* extending between a leading edge and a trailing edge thereof.

Alternatively, starting in the nose section 17*n* or shoulder section 17*s*, each blade 15, 16 may have a row of backup pockets formed in the respective bearing face 15*f*, 16*f* thereof and extending therealong. Each backup pocket may be aligned with or slightly offset from a respective leading pocket. Backup cutters (not shown) may be mounted, such as by brazing, in the backup pockets formed in the bearing faces 15*f*, 16*f* of the blades 15, 16. The backup cutters may be pre-formed, such as by high pressure and temperature sintering. The backup cutters may extend along at least the shoulder section 17*s* of each blade 15, 16. Alternatively, the drill bit 2 may further include shock studs protruding from the bearing face 15*f* of each movable blade 15 in the cone section 17*c* and each shock stud may be aligned with or slightly offset from a respective leading cutter 14.

One or more (eight shown) ports 28*p* may be formed in the body 20 and each port may extend from the plenum and through the lower portion thereof to discharge the drilling fluid 7 along the fluid courses. A nozzle 28*n* may be disposed in each port 28*p* and fastened to the body 20. Each nozzle 28*n* may be fastened to the body 20 by having a threaded coupling formed in an outer surface thereof and each port 28*p* may be a threaded socket for engagement with the respective threaded coupling. The ports 28*p* may include an inner set of one or more (four shown) ports disposed in the cone section 17*c* and an outer set of one or more (three shown) ports disposed in the nose section 17*n* and/or shoulder section 17*s*. Each inner port 28*p* may be disposed between an inner end of a respective fixed blade 16 and the center of the cutting face 17.

Each blade 15, 16 may also have a gage portion including an essentially flat pad 21*p* and the gage trimmers 26. Each gage pad 21*p* may extend upward from the shoulder portion 17*s* of the respective blade 15, 16 to an exposed outer surface to an upper end thereof. An outermost portion of each gage trimmer 26 may define the gage diameter of the drill bit 2. The gage trimmers 26 may be precisely toleranced or have flats (not shown) formed the outermost portions to set the gage diameter of the drill bit 2. The gage trimmers 26 of the fixed blades 16 may be in engagement with the soft formation 13*h* when the movable blades are in the extended position but may only perform a secondary cutting duty.

Each cutter 14 and gage trimmer 26 may be a shear cutter and include a superhard cutting table, such as polycrystalline diamond (PCD), attached to a hard substrate, such as a cermet, thereby forming a compact, such as a polycrystalline diamond compact (PDC). The cermet may be a carbide cemented by a Group VIIIB metal, such as cobalt. The substrate and the cutting table may each be solid and cylindrical and a diameter of the substrate may be equal to a diameter of the cutting table. A working face of each cutter 14 and gage trimmer 26 may be opposite to the substrate and may be smooth and planar. Each gage protector 22 may be similar to the cutter 14 except for being radially oriented instead of tangentially oriented.

While the foregoing is directed to embodiments of the present disclosure, other and further embodiments of the disclosure may be devised without departing from the basic scope thereof, and the scope of the invention is determined by the claims that follow.

The invention claimed is:

1. A bit for drilling a wellbore, comprising:
- a shank having a coupling formed at an upper end thereof;
- a body removably attached to a lower end of the shank and having a blade receptacle formed therethrough;
- a blade fixed to the body;
- a plurality of superhard cutters mounted along a leading edge of the fixed blade;
- a blade disposed in the blade receptacle and longitudinally movable relative to the body between an extended position and a retracted position;
- a plurality of superhard cutters mounted along a leading edge of the movable blade; and
- a spring disposed between the shank and the movable blade and biasing the movable blade toward the extended position, wherein:
- the movable blade is repeatedly movable between the positions, and
- the bit is configured such that:
  - the cutters of the movable blade engage a bottom of the wellbore and the cutters of the fixed blade are disengaged from the bottom of the wellbore while the movable blade is in the extended position, and
  - the cutters of both the fixed and movable blades engage the bottom of the wellbore while the movable blade is in the retracted position.

2. The bit of claim 1, wherein a stroke of the movable blade between the extended and retracted positions ranges between one-half and one times a diameter of the superhard cutters.

3. The bit of claim 1, wherein a shifting force of the spring ranges between ⅓ and ⅔ of a maximum weight on bit of the bit.

4. The bit of claim 1, wherein the spring comprises a stack of Belleville washers.

5. The bit of claim 4, wherein:
- the spring further comprises a guide pin having the stack of Belleville washers disposed therearound, and
- the spring is disposed in a spring socket formed in the shank and a spring socket formed in the movable blade.

6. The bit of claim 1, wherein:
- a lower portion of the body, the blades, and the cutters form a cutting face,
- the movable blade extends from a center of the cutting face, and
- the fixed blade extends from a periphery of a cone section of the cutting face.

7. The bit of claim 1, further comprising a key disposed in a keyway formed in the movable blade and a keyway formed in the body adjacent to the blade receptacle, thereby radially coupling the movable blade to the body while allowing for the longitudinal movement between the extended and retracted positions.

8. The bit of claim 1, wherein:
- the shank has a plurality of gage pads protruding therefrom and formed therearound, and
- one of the gage pads has a hole extending from an upper portion thereof,
- the body or the fixed blade has a threaded socket formed therein and corresponding to the hole, and
- the bit further comprises a threaded fastener disposed in the hole and the threaded socket.

9. The bit of claim 1, further comprising a torque pin disposed in a socket formed in the body and a socket formed in the shank.

10. The bit of claim 1, wherein:
- an inner surface of the movable blade has a shoulder formed therein,
- an inner surface of the body adjacent to the blade receptacle has a shoulder formed therein,
- the shoulders are engaged in the extended position, and
- a top of the movable blade is engaged with a bottom of the shank in the retracted position.

11. The bit of claim 1, wherein:
- the shank has a flow bore formed therethrough,
- the body has a plenum formed therein in fluid communication with the flow bore, and
- the body has a plurality of ports extending from the plenum and through a lower portion thereof.

12. The bit of claim 1, wherein:
- the shank is made from steel, and
- the body, the fixed blade, and the movable blade are each made from a composite matrix material.

13. The bit of claim 1, further comprising:
- a second blade fixed to the body;
- a plurality of superhard cutters mounted along a leading edge of the second fixed blade;
- a second blade disposed in a second receptacle of the body and longitudinally movable relative to the body between the extended position and the retracted position;
- a plurality of superhard cutters mounted along a leading edge of the second movable blade; and
- a second spring disposed between the shank and the second movable blade and biasing the second movable blade toward the extended position.

14. A method of drilling a wellbore using the bit of claim 1, comprising:
- connecting the bit to a bottom of a pipe string, thereby forming a drill string;
- lowering the drill string into the wellbore until the bit is adjacent to a bottom thereof;
- rotating the bit and injecting drilling fluid through the drill string while exerting a first weight on the bit (WOB), thereby drilling the bottom of the wellbore while the movable blade is in the extended position; and
- exerting a second WOB greater than the first WOB on the bit, thereby retracting the movable blade and drilling the bottom of the wellbore while the movable blade is in the retracted position.

15. The method of claim 14, wherein:

the bit is drilling a soft formation adjacent to the bottom of the wellbore while the movable blade is in the extended position, and the bit is drilling a hard formation adjacent to the bottom of the wellbore while the movable blade is in the retracted position.

* * * * *